US009724952B2

(12) United States Patent
Ruan et al.

(10) Patent No.: US 9,724,952 B2
(45) Date of Patent: Aug. 8, 2017

(54) BINDING DEVICE FOR BINDING MACHINES AND A PUNCHING AND BINDING INTERGRATIVE MACHINE

(71) Applicants: Zhejiang Zhiyuan Office Equipment Manufacturing Co., LTD, Huzhou (CN); Shanghai Az Winner International Trade Ltd, Shanghai (CN)

(72) Inventors: Yonghua Ruan, Huzhou (CN); Jingsong Jiang, Huzhou (CN); Xianbin Tan, Huzhou (CN); Ende Jiang, Huzhou (CN)

(73) Assignees: Zhejiang Zhiyuan Office Equipment Manufacturing Co., LTD, Huzhou, Zhejiang (CN); Shanghai Az Winner International Trade Ltd, Shanghai (CN)

( * ) Notice: Subject to any disclaimer, the term of this patent is extended or adjusted under 35 U.S.C. 154(b) by 489 days.

(21) Appl. No.: 14/309,934

(22) Filed: Jun. 20, 2014

(65) Prior Publication Data

US 2015/0147139 A1 May 28, 2015

(30) Foreign Application Priority Data

Nov. 28, 2013 (CN) ..... 2013 1 0614604
Nov. 28, 2013 (CN) ..... 2013 1 0614609

(51) Int. Cl.
*B42B 5/06* (2006.01)
*B42B 5/08* (2006.01)

(52) U.S. Cl.
CPC . *B42B 5/08* (2013.01); *B42B 5/06* (2013.01)

(58) Field of Classification Search
CPC ..... B42B 5/06; B42B 5/08
USPC ..... 412/38, 42
See application file for complete search history.

(56) References Cited

U.S. PATENT DOCUMENTS 6,074,152 A * 6/2000 Vecchi ..... B42B 5/08 412/40
8,475,105 B2 * 7/2013 Coric ..... B42B 5/103 412/38
2013/0071206 A1 * 3/2013 Chiang ..... B42B 5/08 412/38

FOREIGN PATENT DOCUMENTS

BE EP 1810838 A1 * 7/2007 ..... B42B 5/08
GB 667716 A * 3/1952 ..... B42B 5/08

* cited by examiner

*Primary Examiner* — Kyle Grabowski
(74) *Attorney, Agent, or Firm* — NK Patent Law, PLLC

(57) ABSTRACT

This invention discloses a binding device for binding machines and a punching and binding integrative machine. The binding device includes a base fixing plate, a support arranged on the said base fixing plate, a pushing block arranged on the said support, and a clip holder arranged on the said base fixing plate and a mounting slot arranged on the said clip holder to accommodate binding clips. The pushing block is equipped with a binding clip press-in slot in a position corresponding to the said mounting slot, and a size deviation compensation device adapted to different specifications of binding clips. The invention is equipped with a size deviation compensation device.

8 Claims, 10 Drawing Sheets

BINDING DEVICE FOR BINDING MACHINES AND A PUNCHING AND BINDING INTERGRATIVE MACHINE

CROSS-REFERENCE TO RELATED APPLICATIONS

This application claims priority to Chinese Patent Application No. 201310614604.0 filed on Nov. 28, 2013, and Chinese Patent Application No. 201310614609.3 filed on Nov. 28, 2013, the contents of each of which are hereby incorporated by reference in their entirety.

TECHNICAL FIELD

The present invention relates to the technical field of binding machines, and more particularly, relates to a binding device for binding machines and a punching and binding integrative machine.

BACKGROUND ART

When the binding machine is working, binding holes are punched on paper at first, and then binding clips (binding rings) are pressed into the paper binding holes to finish binding. For example, a Chinese Patent with the publication No. CN102653194A and publication date Sep. 5, 2012 discloses a binding machine, comprising a stand, a punching structure mounted on the said stand and a transmission mechanism, wherein, the said punching structure comprises a first punching member provided with a plurality of first punching blades, a second punching member provided with a plurality of second punching blades, and a switching mechanism enabling the first punching member and the second punching member to be respectively separated and reunited with the transmission mechanism. The binding machine provided by the invention is provided with two punching blades capable of punching two holes so as to meet the requirement of different customers. However, the existing binding machine is only applicable to one binding clip, has to be changed when diameter of the binding clips is changed, and has poor applicability.

SUMMARY OF THE INVENTION

This invention intends to provide a binding device for binding machines and a punching and binding integrative machine to solve the weakness of prior art. It has a simple structure, is easy to operate, is capable of binding with binding clips of different specifications by only one binding machine, and has high working efficiency.

To solve the above technical problems, this invention provides the following technical scheme: a binding device for binding machines, comprising a base fixing plate, a support arranged on the said base fixing plate, a pushing block arranged on the said support, and a clip base arranged on the said base fixing plate; a mounting slot arranged on the said clip base to accommodate binding clips; the said pushing block is equipped with a binding clip press-in slot in a position corresponding to the said mounting slot; further comprising a size deviation compensation device adapted to different specifications of binding clips.

After repeated researches and tests, the applicant found that there is a press-in position between the binding hole and binding clip to ensure smooth press fit between the binding hole and binding clip in the press fit process of punched paper and binding clip, and the binding hole and binding clip can achieve smooth press fit in this press-in position, but are unable to achieve smooth press fit in other positions. After changing binding clips, outer diameter of the binding clips is changed, so that the relative position between the binding hole and the binding clip is changed, and press fit is unable to be achieved. Therefore, a size deviation compensation device is arranged in this invention to adjust the position of binding clip or paper through the size deviation compensation device, and compensate the relative position change caused by the diameter change of binding clips, so as to achieve smooth press fit between the binding hole on paper and binding clips in the press-in position, and adapt to binding clips of different specifications.

Preferably, the said size deviation compensation device comprises a slide holder arranged on the said base fixing plate, a side plate hinged with the said slide holder, a base plate connected to the said side plate, and an elastic reset device used to generate an elastic resetting force to the said side plate when the said side plate rotates. The said mounting slot is connected to the said base plate and the said side plate, and binding clips, if arranged in the mounting slot, come into contact with the said base plate and the said side plate.

Preferably, the said size deviation compensation device comprises a base plate hinged with the said clip holder, a side plate connected to the said base plate, and an elastic reset device used to generate an elastic resetting force to the said side plate when the said side plate rotates. The said mounting slot is connected to the said base plate and the said side plate, and binding clips, if arranged in the said mounting slot, come into contact with the said base plate and the said side plate.

Preferably, the said elastic reset device is a tension spring, and the said tension spring is connected to the support at one end and to the said side plate or base plate at the other end.

Preferably, the said elastic reset device is one or a combination of compressed spring, an elastic rubber or a carbon fiber plate generating an elastic resetting force, which is a pushing force.

Preferably, the said side plate is a vertical plate, the said base plate is an inclined plate, and the said base plate form an angle of 80-87 degrees with the said side plate.

Preferably, the said binding clip press-in slot comprises a guide-in slot and a limit slot connected to the said guide-in slot, width of the said limit slot is less than that of the said guide-in slot.

Preferably, the said base plate is an integrated plate under the said clip holder, or a plurality of supporting plates less wider than the said mounting slot, and the said supporting plates are under or within the said mounting slot.

Preferably, the said size deviation compensation device comprises a side plate, a base plate connected to the said side plate and a flexible connector connected to the said side plate and/or the said base plate.

Preferably, the said size deviation compensation device comprises a rotary shaft, at least two gears fixed on the said rotary shaft, two gear racks engaged with the said two gears, a guiding slot to accommodate the said two gear racks, and a paper carrier arranged between the said two gear racks.

Preferably, a plurality of auxiliary spring support devices are arranged between the said base fixing plate and the said base plate to support the said base plate, the said auxiliary spring support device comprises a support body and a mounting chamber within the said support body. The said mounting chamber is equipped therein with a contact steel ball coming into contact with the said base plate, an upper inclined elastic plate used to support the said contact steel ball, a lower inclined elastic plate under the said upper inclined elastic plate, a transitional curved plate connecting the said upper inclined elastic plate with the lower inclined elastic plate, and an intermediate elastic plate; the distance between the said upper inclined elastic plate and the said intermediate elastic plate is gradually shortened as approaching the said transitional curved plate. The distance between the said lower inclined elastic plate and the said intermediate elastic plate is gradually shortened as approaching the said transitional curved plate. The said intermediate elastic plate, upper inclined elastic plate and transitional curved plate form an upper storage chamber. The said intermediate elastic plate, lower inclined elastic plate and transitional curved plate form a lower storage chamber. The end of the said intermediate elastic plate close to the said transitional curved plate is a free end and is provided with a front clearance from the said transitional curved plate. The end of the said upper inclined elastic plate away from the said transitional curved plate is a free end and is provided with a back clearance from the side wall of the said mounting chamber. A plurality of steel balls with gradually increasing diameters are placed within the said upper storage chamber as approaching the said back clearance, and an elastic ball is arranged at the end of the said lower storage chamber away from the said front clearance.

Preferably, when the said contact steel ball is in situ, the end of the said upper inclined elastic plate close to the said transitional curved plate comes into contact with the said steel ball, and the said elastic ball comes into contact with both the said intermediate elastic plate and lower inclined elastic plate; adjacent steel balls of the said a plurality of steel balls come into contact with each other; the steel ball nearest to the said transitional curved plate contacts with the said transitional curved plate; there is a clearance between the steel ball furthest from the said transitional curved plate and the side wall of said upper storage chamber, and when the said contact steel ball declines due to the pressure of the said base plate, the said a plurality of steel balls are pressed to move in a direction away from the said transitional curved plate.

The contact steel ball contacts with the base plate. When the binding machine is working, the base plate is pressed, so that the contact steel ball declines and generates pressure on the upper inclined elastic plate. Then the pressure is transferred from the upper inclined elastic plate to a plurality of steel balls, and a plurality of steel balls move in a direction away from the transitional curved plate. Under the circumstances, the contact steel ball rapidly declines, and then slowly declines. Here, the elastic force of the intermediate elastic plate also supports the contact steel ball. Then the elastic ball is pressed, is limited to the space, and can only have elastic deformation to support the base of the intermediate elastic plate and provide corresponding elastic force; the above structure can ensure more accurate press fit between the binding clip and the binding hole.

Preferably, the said upper inclined elastic plate is provided with a copper plate contacting with the said contact steel ball, and the surface of the said copper plate contacting with the contact steel ball is a smooth surface.

A punching and binding integrative machine, comprising a punching device, a transmission mechanism, a binding device, a paper backrest and a handle, and further comprising the above binding device for binding machines.

The Beneficial Effect of this Invention

The binding device and the punching and binding integrative machine in this invention is equipped with a size deviation compensation device, adjusts the position of binding clip or paper through the size deviation compensation device, and compensates the relative position change caused by the diameter change of binding clip, so as to achieve smooth press fit between the paper binding hole and binding clip in the press-in position, adapt to binding clips of different specifications, and improve the working efficiency.

BRIEF DESCRIPTION OF THE DRAWINGS

This invention is further illustrated in the light of the following figures.

Figure 1:
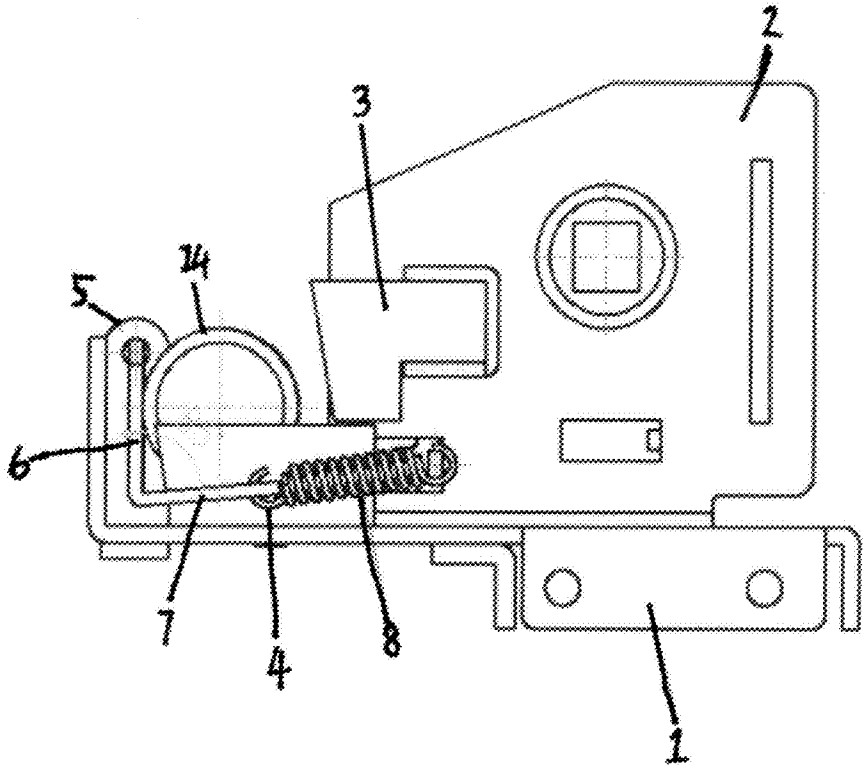
FIG. 1 is the structural diagram of the binding device in Embodiment 1 of this invention.
Figure 2:
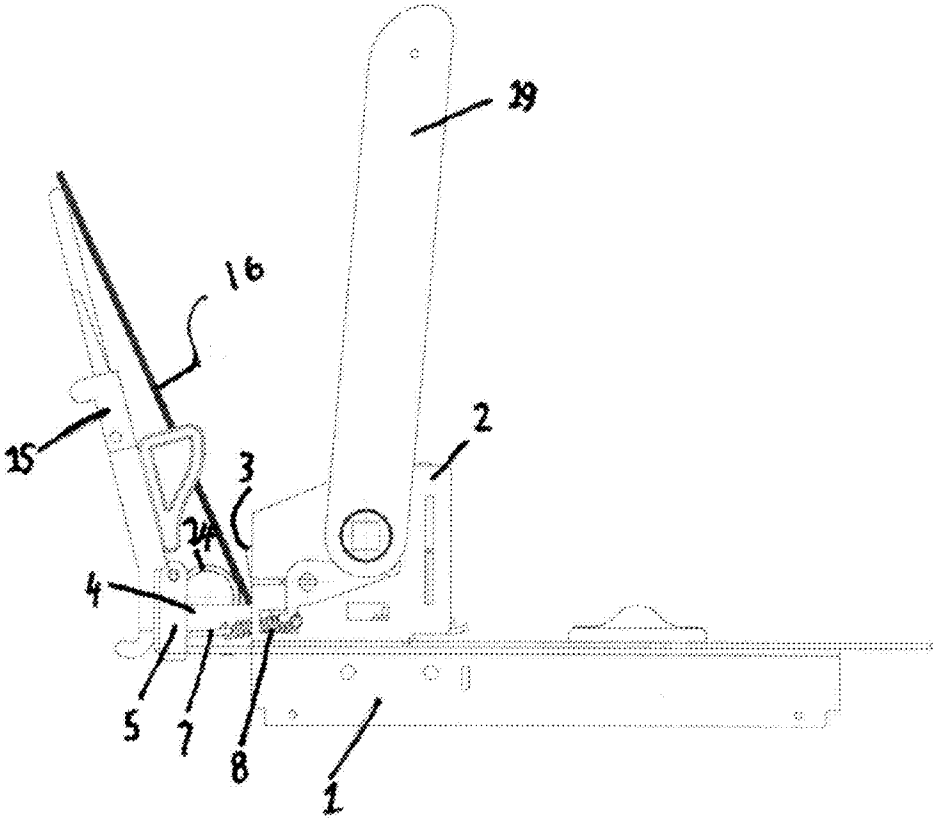
FIG. 2 is the schematic diagram of application of FIG. 1 in the binding machine.
Figure 3:
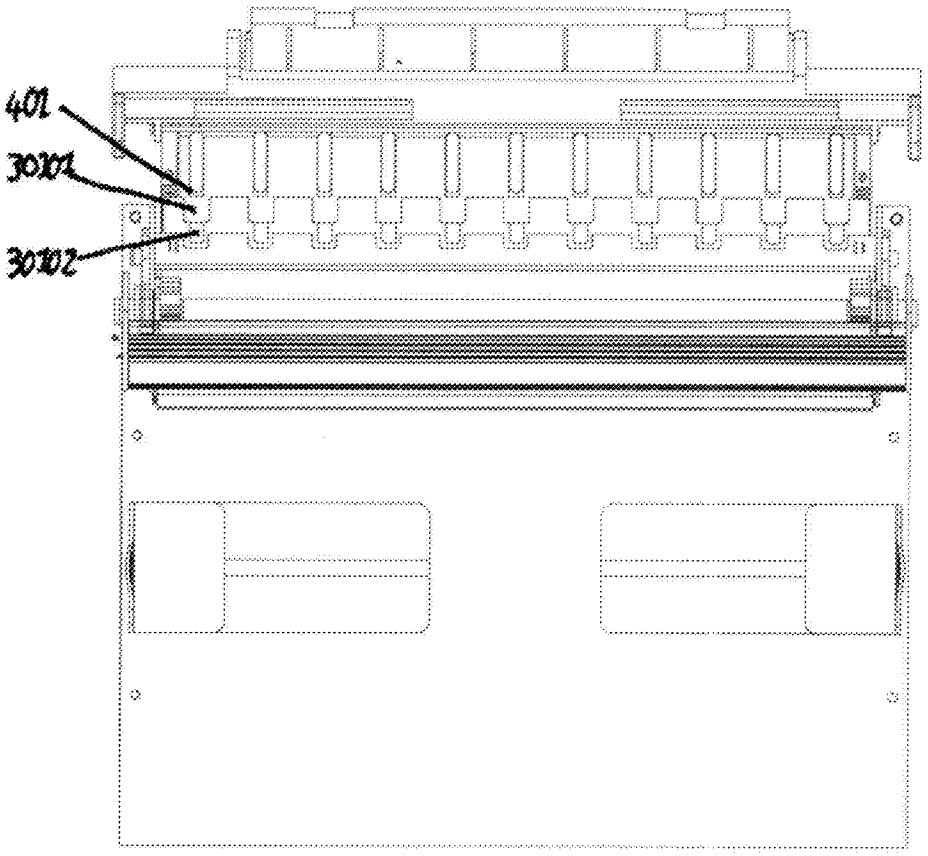
FIG. 3 is the top view of FIG. 2.
Figure 4:
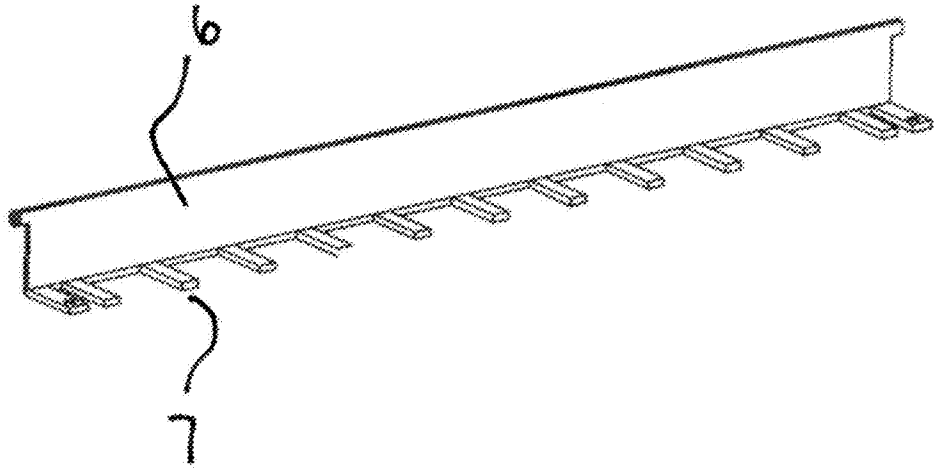
FIG. 4 is the structural diagram of the pushing block.
Figure 5:
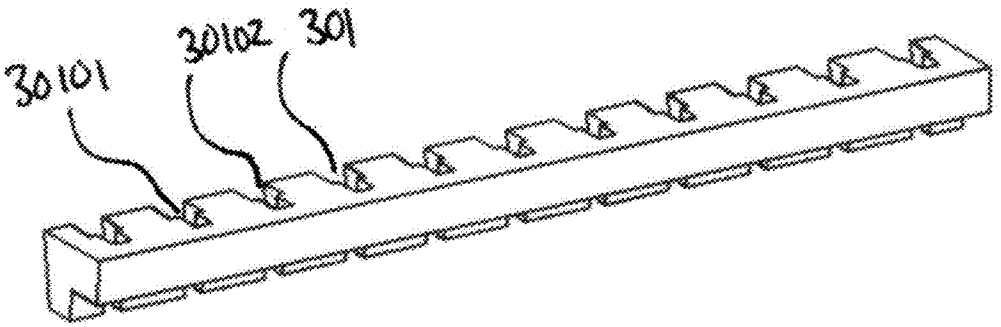
FIG. 5 is the schematic diagram of the connection between the side plate and base plate.

wherein:

1—Base fixing plate;
2—Support;
3—Pushing block, 301—Binding clip press-in slot;
4—Clip holder, 401—Mounting slot;
5—Slide holder;
6—Side plate;
7—Base plate;
8—Elastic reset device;
13—Paper carrier;
14—Binding clip;
15—Paper backrest;
16—Paper.

DETAILED DESCRIPTION OF THE INVENTION

Following descriptions are only preferential embodiments of the present invention, and are not intended to restrict the scope of this invention.

Embodiment 1: as shown in FIGS. 1, 2, 3, 4 and 5, a punching and binding integrative machine applicable for binding clips of different specifications, comprising a punching device, a binding device, a transmission mechanism, a paper backrest 15 and a handle 19, wherein, the punching device is applicable for processing of one or several types of binding holes, the transmission mechanism plays a role in connection and transmission, and the handle 19, the punching device and the binding device are connected to achieve punching and press fit, which are all well-known structure and are not further illustrated in detail here; and a binding device for binding machines, comprising a base fixing plate 1, a support 2 arranged on the said base fixing plate 1, a pushing block 3 arranged on the said support 2, and a clip holder 4 arranged on the said base fixing plate 1, wherein, a mounting slot 401 arranged on the said clip holder 4 to accommodate the binding clips, the said pushing block 3 is equipped with a binding clip press-in slot 301 in a position corresponding to the said mounting slot 401; when working, the pushing block 3 can slide to press the paper 16, so that the paper 16 slide towards the mounting slot 401; binding clip 14 is arranged within the mounting slot 401 to achieve press fit between the binding clip 14 and the paper binding hole, which are all well-known techniques and are not further illustrated in detail here; further comprising a size deviation compensation device adapted to different specifications of binding clips. In this embodiment, the said size deviation compensation device comprises a slide holder 5 arranged on the said base fixing plate 1, a side plate 6 hinged with the said slide holder 5, a base plate 7 connected to the said side plate 6, and a elastic reset device 8 used to generate an elastic resetting force to the said side plate 6 when the said side plate 6 rotates. The said mounting slot 401 is connected to the said base plate 7 and the said side plate 6, and binding clips, if arranged within the said mounting slot 401, contact with the said base plate 7 and the said side plate 6; the slide holder 5 is fixed on the base fixing plate 1 on the side of clip holder away from the pushing block 3. The mounting slot 401 passes through the bottom of the slide holder 5 and the side face close to the slide holder 5, so that the said base plate 7 is connected to the said side plate 6. In this way, when placing in the mounting slot, binding clips contact with the said base plate 7 and the said side plate 6; the elastic reset device 8 in this embodiment is a tension spring, and the said tension spring is connected at one end to the support 2 via a connecting plate arranged on the support 2, and connected at the other end to the said side plate 6 or base plate 7, and preferably connected to the base plate 7; when working, binding clips are placed in the mounting slot. The punched paper 16 is placed on the clip holder 4. The upper end of punched paper is held by the paper backrest 15. The paper is then pushed by the pushing block 3 to move towards the binding clip, until coming into contact with the binding clip. At this time, positions of the two are not suitable for completing binding. The pressure of paper acts on the binding clip, so that the binding clip resists the elastic force of the tension spring, the side plate 6 rotates and declines, until the position of the binding clip and the punching hole on the paper is suitable for completing press-in; therefore, the position of binding ring is adjusted by the side plate 6, the base plate 7 and the tension spring, and the whole binding device is adapted to binding rings of different specifications; furthermore, in order to achieve better binding effect and adjust the position of various binding rings, the said side plate 6 is a vertical plate hinged with the slide holder 5 via a hinging shaft. The said base plate 7 is an inclined plate, and the said base plate 7 forms an angle of 80-87° with the side plate 6, preferably 85°. The said binding clip press-in slot 301 comprises a guide-in slot 30101 and a limit slot 30102 connected to the said guide-in slot 30101, width of the limit slot 30102 is less than that of the guide-in slot 30101. During press fit of the paper, a part of the paper first enters the guide-in slot and guided by the wider guide slot before entering the limit slot, so as achieve press fit with the binding clip; this structure can fast achieve a favorable press fit effect; the said base plate 7 is an integrated plate under the said clip holder 4, or a plurality of supporting plates less wider than the said mounting slot 401. The said supporting plates are under or within the said mounting slot 401. In this embodiment, the base plate 7 is a structure with a plurality of supporting plates. The outermost two supporting plates are extruded out and connected to the tension spring.

Figure 6:
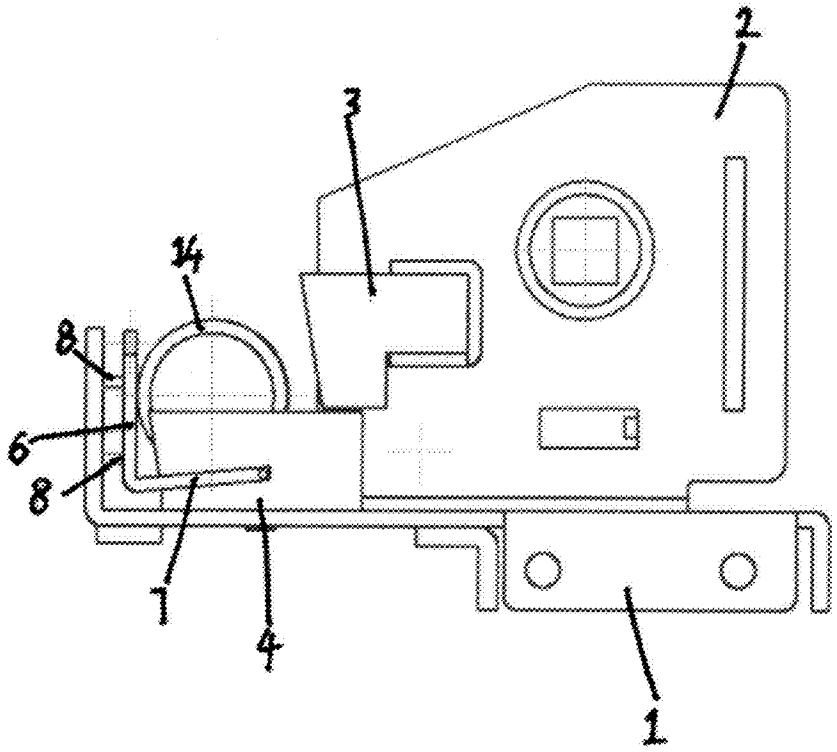
FIG. 6 is the structural diagram of the binding device in Embodiment 2 of this invention.

Embodiment 2: as shown in FIG. 6, the said size deviation compensation device comprises a base plate 7 hinged with the said clip holder 4, a side plate 6 connected to the said base plate 7, and an elastic reset device 8 used to generate an elastic resetting force to the said base plate 7 when the said base plate 7 rotates. The said mounting slot 401 is connected to the said base plate 7 and the said side plate 6, and binding clips, if arranged within the said mounting slot 401, contact with the said base plate 7 and the said side plate 6; in this embodiment, the base plate 7 is hinged with the clip holder 4 via a hinging shaft. The said elastic reset device 8 may be a tension spring in Embodiment 1 or be that in this embodiment. In this embodiment, the elastic reset device is one or a combination of a compressed spring, an elastic rubber or a carbon fiber plate generating an elastic resetting force, which is a pushing force, and others are similar to those in Embodiment 1.

Figure 7:
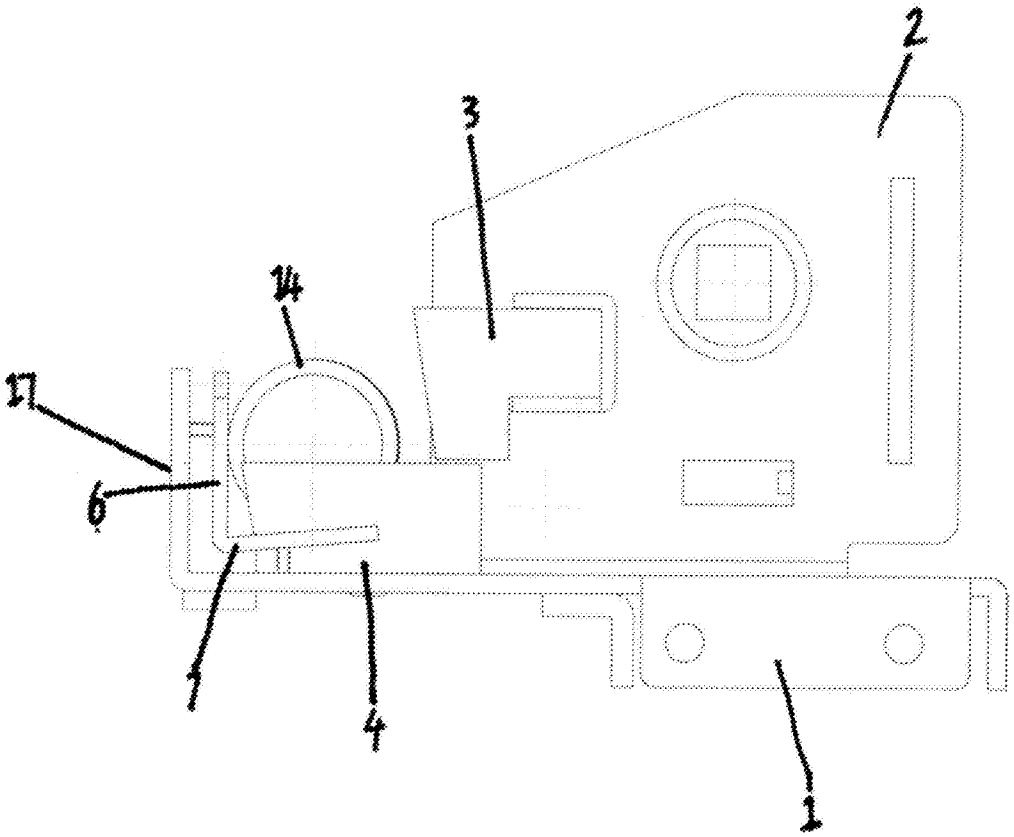
FIG. 7 is the structural diagram of the binding device in Embodiment 3 of this invention.

Embodiment 3: as shown in FIG. 7, the said size deviation compensation device comprises a side plate 6, a base plate 7 connected to the said side plate 6 and a flexible connector connected to the said side plate 6 and/or the said base plate 7; in this embodiment, the side plate 6 and/or the said base plate 7 is connected to a flexible connector, and the flexible connector is a compressed spring or an elastic rubber, and is two compressed springs in this embodiment. One compressed spring is arranged on the base fixing plate and connected to the base plate 7, while the other compressed spring is arranged on the side plate 6. An end supporting plate 17 is arranged at the end of the base fixing plate, and the other end of the compressed spring connected to the side plate 6 is fixed to the end supporting plate 17, and others are similar to those in Embodiment 1.

Figure 8:
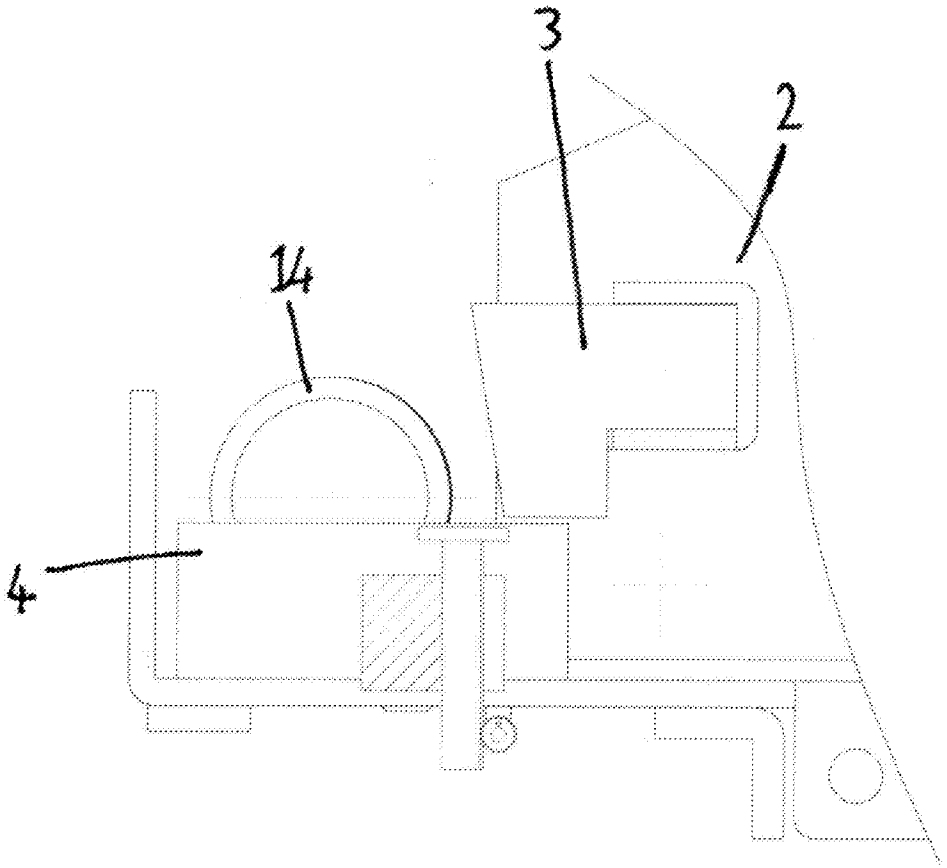
FIG. 8 is the structural diagram of the binding device in Embodiment 4 of this invention.

Embodiment 4: as shown in FIG. 8, the said size deviation compensation device comprises a rotary shaft, at least two gears fixed on the rotary shaft, two gear racks engaged with the said two gears, a guiding slot used to accommodate the said two gear racks, and a paper carrier arranged between the said two gear racks; the rotary shaft is mounted on the base fixing plate. The base fixing plate is equipped with a hinge fit with the rotary shaft, and the rotation of the rotary shaft drives the gear racks to go up or down, thereby adjusting the paper position on the paper carrier.

Figure 9:
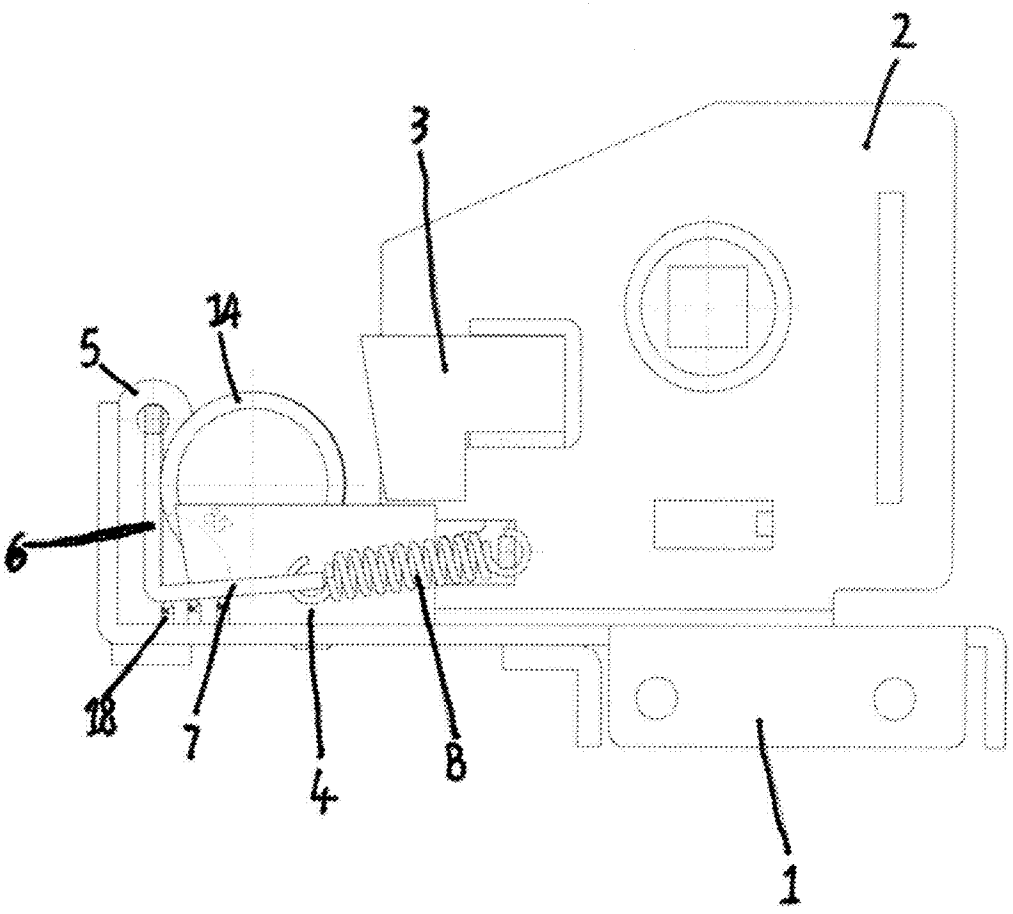
FIG. 9 is the structural diagram of the binding device in Embodiment 5 of this invention.
Figure 10:
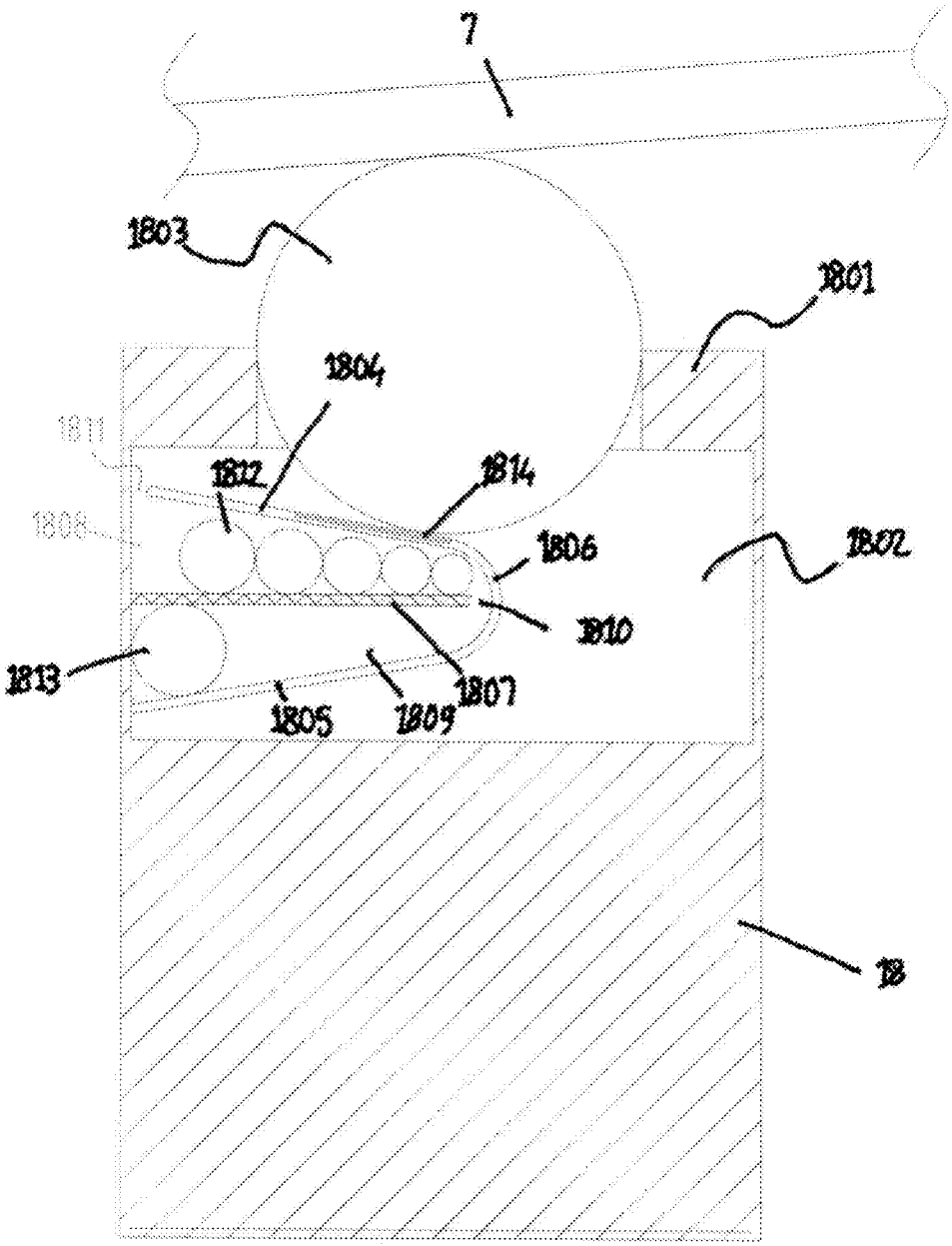
FIG. 10 is the structural diagram of the auxiliary spring support device in FIG. 9.

Embodiment 5: as shown in FIG. 9 and FIG. 10, a plurality of auxiliary spring support devices 18 are arranged between the base fixing plate 1 and the base plate 7 to support the base plate 7 and ensure the stability and accuracy of press fit between the binding clip and the binding hole of paper; the base plate 7 is an inclined plate, and its distance from the base fixing plate 1 is enlarged as it gets away from the elastic reset device 8; the auxiliary elastic support device 18 comprises a support body 1801 and a mounting chamber 1802 arranged within the support body 1801. The mounting chamber 1802 is equipped therein with a contact steel ball 1803 contacting with the base plate 7. Part of the contact steel ball 1803 extrudes from the upper opening of the mounting chamber 1802, contacts with the base plate 7, and the extruded part of the contact steel ball depends on the diameter or width of the upper opening; the mounting chamber is also equipped therein with an upper inclined elastic plate 1804 used to support the contact steel ball 1803, a lower inclined elastic plate 1805 under the upper inclined elastic plate 1804, an transitional curved plate 1806 connecting the upper inclined elastic plate 1804 with the lower inclined elastic plate 1805, and an intermediate elastic plate 1807; the intermediate elastic plate 1807 is between the upper inclined elastic plate and lower inclined elastic plate. The transitional curved plate may be an elastic plate; the upper inclined elastic plate, lower inclined elastic plate and intermediate elastic plate are integrated or separately assembled; the distance between the upper inclined elastic plate 1804 and the intermediate elastic plate 1807 is gradually shortened as approaching the transitional curved plate 1806. The distance between the lower inclined elastic plate 1805 and the intermediate elastic plate 1807 is gradually shortened as approaching the transitional curved plate 1806. The intermediate elastic plate 1807, upper inclined elastic plate 1804 and transitional curved plate 1806 form an upper storage chamber 1808. The intermediate elastic plate 1807, lower inclined elastic plate 1805 and transitional curved plate 1806 form a lower storage chamber. The end of the intermediate elastic plate 1807 close to the transitional curved plate 1806 is a free end and is provided with a front clearance 1810 from the transitional curved plate 1806. The end of the upper inclined elastic plate 1804 away from the transitional curved plate 1806 is a free end and is provided with a back clearance 1811 from the side wall of the mounting chamber 1802. The upper storage chamber 1808 is equipped therein with a plurality of steel balls 1812 with gradually increasing diameters as approaching the back clearance 1811, and an elastic ball 1813 is arranged at the end of the lower storage chamber 1809 away from the front clearance 1810; when the contact steel ball 1803 is in situ, i.e. without press fit between the binding clip and binding hole, the end of the upper inclined elastic plate 1804 close to the transitional curved plate 1806 contacts with the contact steel ball 1803, here the elastic ball 1813 contacts with both the intermediate elastic plate 1806 and the lower inclined elastic plate 1805; adjacent steel balls 1812 of a plurality of steel balls 1812 installed within the upper storage chamber contact with each other; in order to achieve this purpose, the intermediate plate may be an inclined plate forming an angle of 0.1-0.3° with the horizontal plane; the steel ball 1812 nearest to the transitional curved plate 1806 contacts with the transitional curved plate 1806. There is a clearance between the steel ball 1812 furthest to the transitional curved plate 1806 and side wall of the upper storage chamber 1808, and when the contact steel ball 1803 declines due to the pressure of the base plate 7, a plurality of steel balls 1812 moves in a direction away from the transitional curved plate 1806; furthermore, the upper inclined elastic plate 1804 is equipped with a copper plate 1814 contacting with the contact steel ball 1803, the surface of copper plate 1814 contacting with the contact steel ball 1803 is a smooth surface, and the smoother the better. The smoothness expressed by roughness is generally Ra1.6 μm~0.4 μm; when contacting with the contact steel ball, a smoother surface facilitates minimizing the frictional force, sliding as fast as possible, and improving the press-in efficiency between the binding clip and the paper binding hole.

The above description is only provided to explain this invention, so that common technicians in this field can completely implement the scheme, and is not intended to limit this invention. After reading the Description, those skilled in this field may modify the embodiments without creative contributions. All these modifications are non-creative, but are protected by the Patent Law as long as falling within the appended claims of this invention.

What is claimed is:

1. A binding device for binding machines, comprising:

a base fixing plate;

a support arranged on the base fixing plate;

a pushing block arranged on the support;

a clip holder arranged on the base fixing plate;

a mounting slot arranged on the clip holder to accommodate binding clips, wherein the pushing block is equipped with a binding clip press-in slot in a position corresponding to the mounting slot;

wherein the device further comprises a size deviation compensation device adapted to different specifications of binding clips; and wherein: the size deviation compensation device comprises a slide holder arranged on the base fixing plate, a side plate hinged with the slide holder, a base plate connected to the side plate, and an elastic reset device used to generate elastic resetting force to the side plate when the side plate rotates; the mounting slot is connected to the base plate and the side plate; and binding clips, if arranged within the mounting slot, come into contact with the base plate and the side plate.

2. The binding device for binding machines defined in claim 1, wherein: the size deviation compensation device comprises a base plate hinged with the clip holder, a side plate connected to the base plate, and an elastic reset device used to generate an elastic resetting force to the base plate when the base plate rotates; the mounting slot is connected to the base plate and the side plate; and binding clips, if arranged within the mounting slot, come into contact with the base plate and the side plate.

3. The binding device for binding machines defined in claim 1, wherein: the elastic reset device is a tension spring, the tension spring is connected to the support at one end and, and to the side plate or base plate at the other end.

4. The binding device for binding machines defined in claim 1, wherein: the said elastic reset device is one or a combination of a compressed spring, an elastic rubber or a carbon fiber plate generating the elastic resetting force, which is pushing force.

5. The binding device for binding machines defined in claim 1, wherein: a plurality of auxiliary elastic support devices are set between the said base fixing plate and the said base plate to support the said base plate, and the said auxiliary spring support device comprises a support body and a mounting chamber arranged within the said support body, wherein the said mounting chamber is equipped therein with a contact steel ball coming into contact with the said base plate, an upper inclined elastic plate used to support the said contact steel ball, a lower inclined elastic plate under the said upper inclined elastic plate, an transitional curved plate connecting the said upper inclined elastic plate with the lower inclined elastic plate, and an intermediate elastic plate; the distance between the said upper inclined elastic plate and the said intermediate elastic plate is gradually shortened as approaching the said transitional curved plate; the distance between the said lower inclined elastic plate and the said intermediate elastic plate is gradually shortened as approaching the transitional curved plate; the said intermediate elastic plate, upper inclined elastic plate and transitional curved plate form an upper storage chamber; the said intermediate elastic plate, lower inclined elastic plate and transitional curved plate form a lower storage chamber; the end of the said intermediate elastic plate close to the said transitional curved plate is a free end and is provided with a front clearance from the transitional curved plate; the end of the said upper inclined elastic plate away from the said transitional curved plate is a free end and is provided with a back clearance from the side wall of the said mounting chamber; a plurality of steel balls with gradually increasing diameters as approaching the said back clearance are placed within the said upper storage chamber, and an elastic ball is arranged at the end away from the said front clearance within the lower storage chamber.

6. The binding device for binding machines defined in claim 5, wherein: when the said contact steel ball is in situ, the end of the said upper inclined elastic plate close to the said transitional curved plate comes into contact with the said contact steel ball; and the said elastic ball comes into contact with both the said intermediate elastic plate and the lower inclined elastic plate; adjacent steel balls of the said a plurality of steel balls come into contact with each other; the steel ball nearest to the said transitional curved plate comes into contact with the said transitional curved plate; there is a clearance between the steel ball furthest from the said transitional curved plate and the side wall of the said upper storage chamber; and when the said contact steel ball declines due to the pressure of the said base plate, the said a plurality of steel balls are pressed to move in a direction away from the said transitional curved plate.

7. The binding device for binding machines defined in claim 6, wherein: the upper inclined elastic plate has a copper plate contacting the contact steel ball, and the surface of copper plate contacting the contact steel ball is smooth.

8. The binding device for binding machines defined in claim 1, wherein: the size deviation compensation device comprises a side plate, a base plate connected to the side plate, and a flexible connector connected to the side plate and/or the base plate.

* * * * *